US011937747B2

(12) United States Patent
Bordin

(10) Patent No.: US 11,937,747 B2
(45) Date of Patent: Mar. 26, 2024

(54) WALL MOUNTABLE SOAP DISH ASSEMBLY AND METHODS OF MAKING AND USING THE SAME

(71) Applicant: Andrew Bordin, Woodbridge (CA)

(72) Inventor: Andrew Bordin, Woodbridge (CA)

( * ) Notice: Subject to any disclaimer, the term of this patent is extended or adjusted under 35 U.S.C. 154(b) by 206 days.

(21) Appl. No.: 17/665,727

(22) Filed: Feb. 7, 2022

(65) Prior Publication Data

US 2022/0296049 A1 Sep. 22, 2022

Related U.S. Application Data

(60) Provisional application No. 63/163,442, filed on Mar. 19, 2021.

(51) Int. Cl.
*A47K 5/02* (2006.01)

(52) U.S. Cl.
CPC ..... *A47K 5/02* (2013.01); *A47K 2201/02* (2013.01)

(58) Field of Classification Search
CPC .. A47K 5/02; A47K 2201/02; A47K 2201/00; A47K 5/03; A47K 5/04; A47K 5/05; A47K 5/00
See application file for complete search history.

(56) References Cited

U.S. PATENT DOCUMENTS 192,997 A * 7/1877 Hopfen ..... A47B 67/02 312/351
1,146,275 A * 7/1915 Pierce ..... A61M 1/1656 248/206.1
1,211,353 A * 1/1917 Rautzenburg ..... A47K 5/02 D6/540
1,305,918 A * 6/1919 May ..... A47K 5/02 312/351
1,437,217 A * 11/1922 Bailly ..... A47K 5/03 206/77.1
1,554,789 A * 9/1925 Crary ..... C11D 17/02 401/28
1,854,415 A * 4/1932 Miller ..... A47K 7/03 15/244.1
1,905,069 A * 4/1933 Stair ..... A47K 5/02 D6/540
2,127,230 A * 8/1938 Moineau ..... A47K 5/02 29/451

(Continued)

*Primary Examiner* — Devin K Barnett
(74) *Attorney, Agent, or Firm* — Ashley D. Johnson; Dogwood Patent and Trademark Law

(57) ABSTRACT

The invention is directed to a soap dish assembly that promotes the longevity of a bar of soap and allows a user to access to the soap without directly handling it. Particularly, the disclosed assembly includes a bottom plate configured to attach to a support surface (e.g., a shower wall). The bottom plate comprises a housing sized and shaped to cooperate with a bar of soap. The soap is therefore retained within the base housing via a middle plate. A front plate attaches to the bottom plate to retain the soap and middle plate therebetween. In use, a sponge or other bathing accessory can contact an exposed surface of the soap, thereby allowing access to the soap without having to directly handle it. Alternatively, a user can rub a desired body part (e.g., their hands) on the exposed portion of the soap for cleaning. As a result, the life of the soap is extended and does not get soggy or softened from excess contact with water during and after use.

19 Claims, 7 Drawing Sheets

(56) References Cited

U.S. PATENT DOCUMENTS 2,489,543 A * 11/1949 Sanford ..... A47K 5/02 312/351
2,577,011 A * 12/1951 Hallenscheid ..... A47K 5/02 D6/524
2,723,487 A * 11/1955 Mardre, Jr. ..... F16B 47/00 248/206.1
2,930,160 A * 3/1960 Pohl ..... A47K 5/03 206/77.1
3,219,402 A * 11/1965 Holman ..... A61M 3/0266 312/213
3,251,639 A * 5/1966 Silowash ..... A47K 5/03 312/351
3,688,895 A * 9/1972 Wilson ..... A47K 5/04 206/557
D231,302 S * 4/1974 Lukawski ..... D7/541
4,157,707 A * 6/1979 Schwind ..... A47J 27/58 220/4.03
4,344,529 A * 8/1982 Ibarzabal ..... A47K 5/02 425/409
4,422,546 A * 12/1983 Charity ..... A47K 5/02 15/244.4
D314,307 S * 2/1991 Bush ..... D7/505
D337,682 S * 7/1993 Crook ..... D6/536
D367,986 S * 3/1996 Haley ..... D6/536
5,509,529 A * 4/1996 Kelley ..... A47K 5/02 220/264
D394,773 S * 6/1998 Patel ..... D7/553.6
D413,219 S * 8/1999 Glenton Kerr ..... D6/536
D511,642 S * 11/2005 Riddell ..... D7/356
D599,594 S * 9/2009 Snell ..... D6/536
D704,953 S * 5/2014 Reitze ..... D6/536
D805,804 S * 12/2017 Li ..... D6/536
2013/0341216 A1* 12/2013 Panzella ..... A47K 3/281 206/223
2018/0049600 A1* 2/2018 Smith ..... A47K 5/02
2018/0263430 A1* 9/2018 Terfous ..... A47K 5/03
2021/0386249 A1* 12/2021 Vicente ..... A47K 5/03

* cited by examiner

WALL MOUNTABLE SOAP DISH ASSEMBLY AND METHODS OF MAKING AND USING THE SAME

CROSS-REFERENCE TO RELATED APPLICATIONS

This application claims priority to U.S. Provisional Patent Application No. 63/163,442, filed Mar. 19, 2022, the entire content of which is hereby incorporated by reference.

TECHNICAL FIELD

The presently disclosed subject matter is directed to a wall mountable soap dish assembly, and to methods of making and using the disclosed assembly.

BACKGROUND

Soap dishes have been widely used around the world for many years to retain bars of soap while a user is bathing or washing their hands at a sink. However, soap dishes undesirably accumulate soapy water each time a wet bar of soap is placed back into the dish. When the bar of soap is left in the soapy water, it dissolves and becomes soft, decreasing the lifespan of the soap. In addition, softened soap is messy to use and does not properly lather during use. Furthermore, the soap dish must be frequently cleaned, requiring time and effort to remove the excess soap buildup. In an effort to overcome these deficiencies, soap dishes containing drain holes have been developed. However, even drainable soap dishes continue to build up moisture and soap residue within the floor of the assembly, Other soap dish designs have developed a wire grid that supports the bar of soap. However, the wires often cut into the soft surface of the soap, removing soap from the bar. The wire grid must also be frequently cleaned to remove soap buildup. Additionally, soap dishes of any type are undesirable as they take up valuable counter space. It would therefore be beneficial to provide an improved soap dish design that overcomes the shortcomings of the prior art.

SUMMARY

In some embodiments, the presently disclosed subject matter is directed to a soap dish assembly comprising a bottom plate defined by a rear face and an opposed top face, wherein the top face includes a recess. The assembly further includes a middle plate configured with a central opening and an outer ring, wherein the outer ring is sized and shaped to be housed within the recess. The assembly includes a front plate defined by a central opening with a circumference that is smaller than the circumference of the middle plate opening. The front plate releasably attaches to the rear plate, such that the middle plate is positioned therebetween.

In some embodiments, the recess comprises a first indentation sized and shaped to accommodate the outer ring and a second indentation within the first indentation.

In some embodiments, the assembly includes a bar of soap defined by a front face, a rear face, and a thickness therebetween, wherein the bar of soap is positioned within the central opening of the middle plate and directly adjacent to the recess.

In some embodiments, the bar of soap has a circumference that is about the same as the middle plate opening.

In some embodiments, the rear face of the bottom plate is planar.

In some embodiments, the rear face of the bottom plate comprises one or more attachment elements selected from double sided tape, adhesive, suction cups, clasps, fasteners, magnets, hook and loop closure, screws, bolts, or combinations thereof.

In some embodiments, the recess has a depth of about 0.1-2 inches.

In some embodiments, the front plate includes a lip positioned adjacent to the central opening, wherein the lip contacts the top face of the bottom plate.

In some embodiments, the front plate includes a hanger.

In some embodiments, the top face of the front plate entirely fits over the top face of the rear plate.

In some embodiments, the soap is flush with the front plate opening.

In some embodiments, wherein the front plate includes a drain in fluid communication with an interior of the assembly.

In some embodiments, the presently disclosed subject matter is directed to a method of using a soap dish assembly. Particularly, the method comprises positioning disclosed the soap dish assembly on a support surface, such that the rear face of the bottom plate is directly adjacent to the support surface. The method includes positioning a bar of soap within the opening of the middle plate and adjacent to the recess, wherein the bar of soap is defined by a front face, a rear face, and a thickness therebetween, and wherein the soap is held in position by the attachment of the front plate to the rear plate. The method further includes accessing the front face and thickness of the soap to clean a surface.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a assembly" can include a plurality of such assemblies, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−0.1-20% from the specified amount, as such variations are appropriate in the disclosed packages and methods.

Figure 1A:
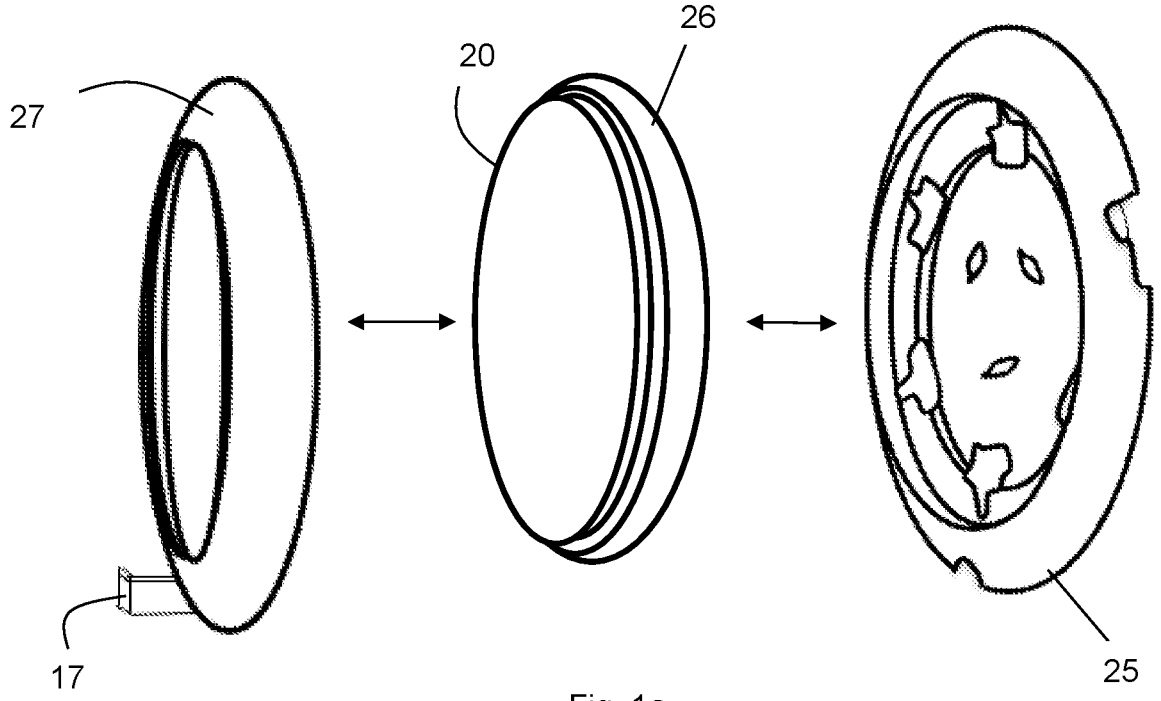
FIG. 1*a* is an exploded perspective view of a soap dish assembly in accordance with some embodiments of the presently disclosed subject matter.
Figure 1B:
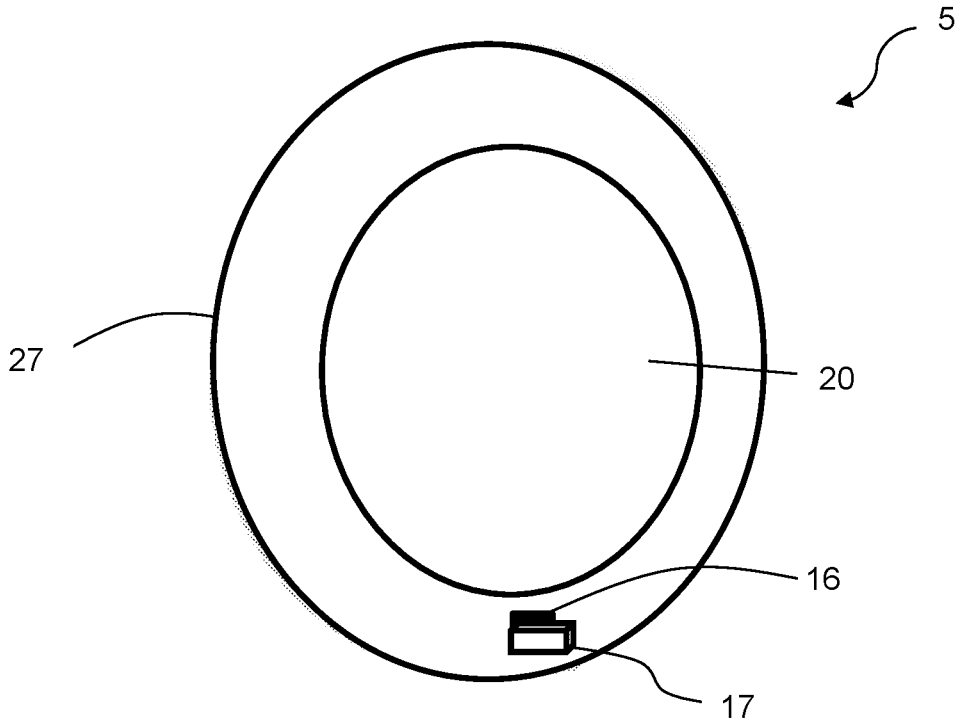
FIG. 1*b* is a perspective view of an assembled soap dish assembly in accordance with some embodiments of the presently disclosed subject matter.
Figure 1C:
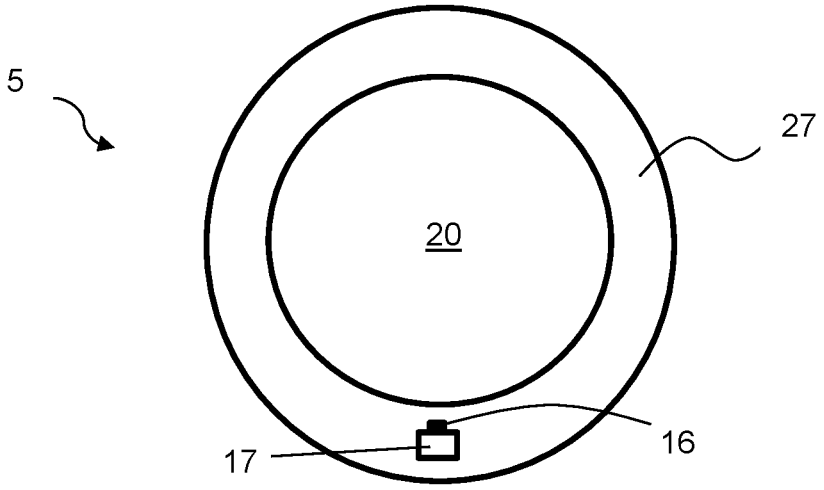
FIG. 1*c* is a top plan view of an assembled soap dish assembly in accordance with some embodiments of the presently disclosed subject matter.

The presently disclosed subject matter is directed to a soap dish assembly that promotes the longevity of a bar of soap and allows a user to access to the soap without directly handling it. As shown in FIGS. 1*a*-1*c*, assembly 5 includes back plate 25 configured to attach to a support surface (e.g., a shower wall). The assembly also includes middle plate 26 that cooperates with soap 20, as described in more detail herein below. The soap is retained within the assembly interior by interaction between front plate 27 and back plate 25. The front plate can include drainage aperture 16 that allows any moisture or water that accumulates within the assembly interior to drain out. The front plate can further include hanger 17 configured to allow a loofa, washcloth, or other device to releasably attach to the assembly. In use, a sponge or other bathing accessory can contact exposed soap 20, allowing access to the soap without having to directly handle it. Alternatively, a user can rub a desired body part (e.g., their hands) on the exposed portion of the soap for cleaning. As a result, the life of soap 20 is extended and does not get soggy or softened from excess contact with water during and after use.

Figure 2A:
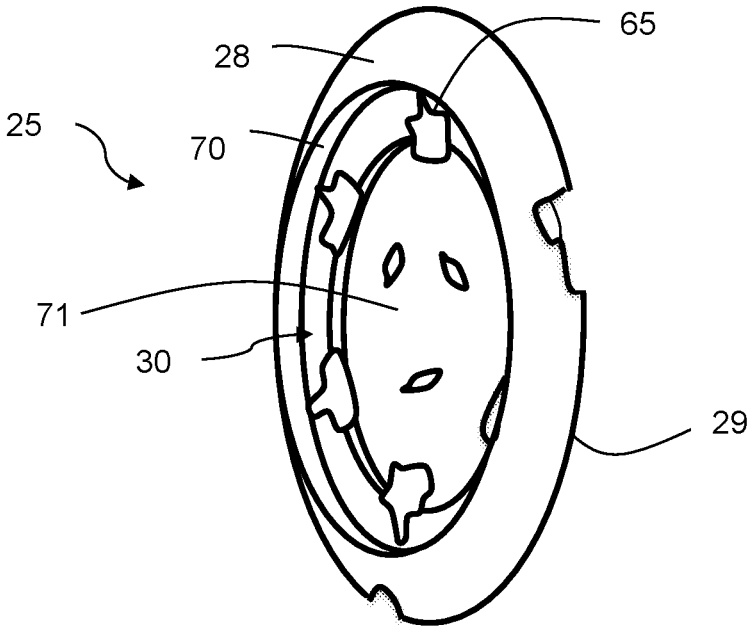
FIG. 2*a* is a perspective view of a bottom plate of a soap dish assembly in accordance with some embodiments of the presently disclosed subject matter.
Figure 2B:
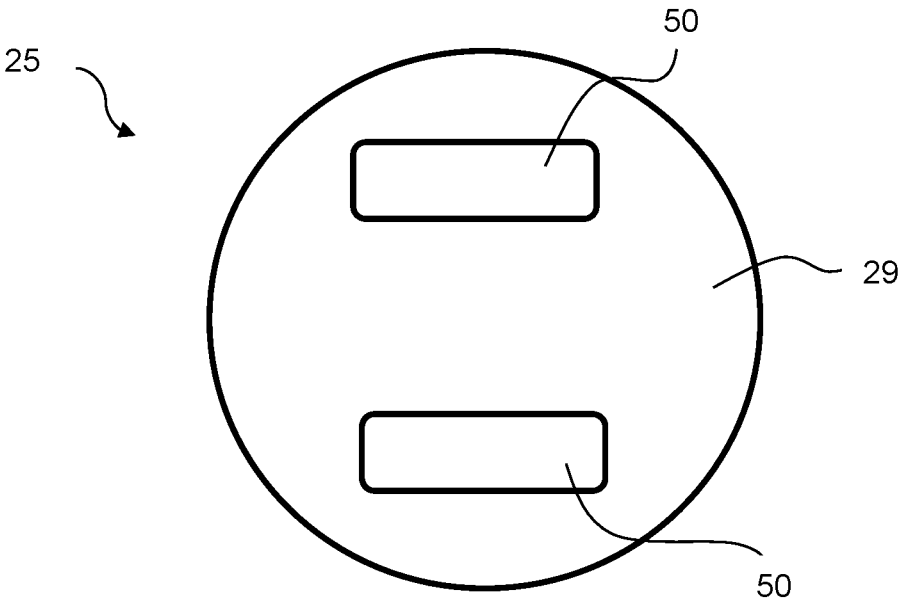
FIG. 2*b* is a rear plan view of a soap dish assembly bottom plate in accordance with some embodiments of the presently disclosed subject matter.

FIG. 2*a* illustrates one embodiment of back plate 25 comprising front face 28 and opposed rear face 29 that attaches to a support surface (e.g., shower wall). In some embodiments, the rear face of back plate 25 can be planar in construction. In this way, the rear plate can easily attach to a level support surface, such as a vertical shower wall. For example, rear face 29 can include one or more attachment elements 50 that enable the assembly to be attached to a desired location on a support surface, as shown in FIG. 2*b*. In some embodiments, attachment elements 50 can comprise double sided tape. However, the presently disclosed subject matter is not limited and any element that allows the bottom plate to be attached to a support surface can be used, such as the use of adhesives, suction cups, and/or welding. In some embodiments, the support surface includes a cooperating attachment element to facilitate connection of the rear plate (e.g., VELCRO®, magnets, clasps, fasteners, screws, bolts, and the like).

Figure 3A:
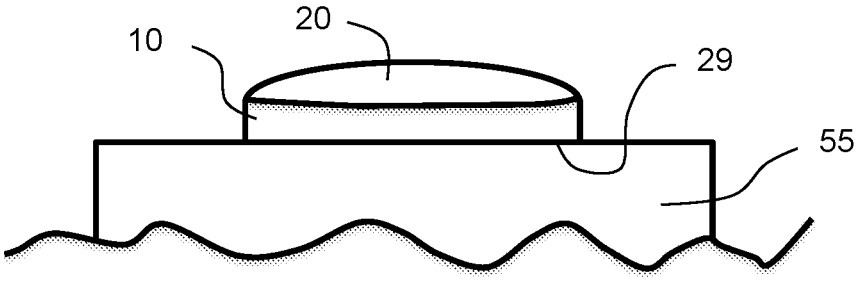
FIG. 3*a* is a side plan view of a soap dish assembly configured on a support surface in accordance with some embodiments of the presently disclosed subject matter.
Figure 3B:
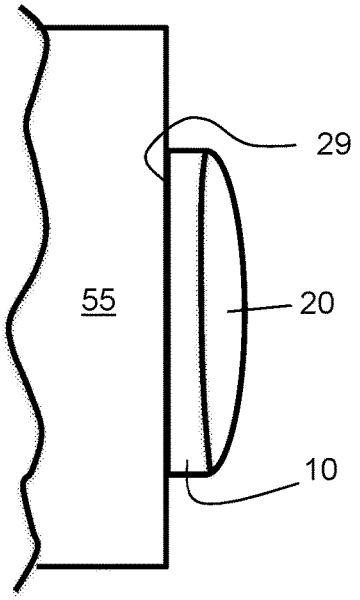
FIG. 3*b* is a side plan view of a soap dish assembly configured on a support surface in accordance with some embodiments of the presently disclosed subject matter.

The attachment elements allow the rear plate (and assembly) to be permanently or releasably attached to support surface 55 (e.g., a bathroom wall). In some embodiments, the attachment elements allow the assembly to be horizontally (about 180 degrees) or vertically (about 90 degrees) attached to a support surface, as shown in FIGS. 3*a* and 3*b*. However, it should be appreciated that the bottom plate can be attached to the support surface at any desired angle (e.g., about 30, 45, 60 degrees relative to horizontal).

The back plate includes central recess 30 sized and shaped for attachment of middle plate 29. The term "recess" refers to a depression that partially extends in the rear plate. The recess can have any desired shape and should be shaped to accommodate the back face of soap 20. Thus, recess 30 can have a round, oval, square, rectangular, etc. shape. The shape of the recess can be the same as an associated bar of soap.

In some embodiments, recess 30 can include first indentation 70 that is sized and shaped to accommodate the ring of middle plate 26. Interior to the first indentation is second indentation 71 that is sized and shaped to accommodate the portion of soap 20 that extends beyond the ring on the rear face. The first and second indentations can have the same shape or different shapes. The term "indentation" refers to an inwardly extending portion.

The recess can have a maximum depth of about 0.1-1 inch or more. Thus, the recess can have a depth of at least about (or no more than about) 0.1, 0.2, 0.3, 0.4, 0.5, 0.6, 0.7, 0.8, 0.9, or 1 inch. However, it should be appreciated that the depth can be greater or less than the range given herein. The length and width of the recess can be about 50-95% of the length and width of the back plate (e.g., at least/no more than about 50, 55, 60, 65, 70, 75, 80, 85, 90, 95 percent). The first indentation can have a depth of about 0.2-0.9 inches (at least/no more than about 0.2, 0.3, 0.4, 0.5, 0.6, 0.7, 0.8, or 0.9 inches). The second indentation can have a depth of about 0.1-0.5 inches (e.g., at least/no more than about 0.1, 0.2, 0.3, 0.4, 0.5 inches).

Figure 3C:
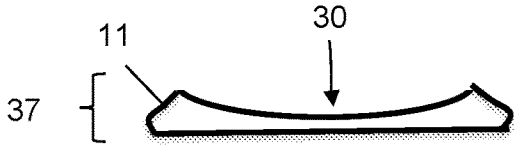
FIG. 3*c* is a side plan view of a bottom plate in accordance with some embodiments of the presently disclosed subject matter.
Figure 3D:
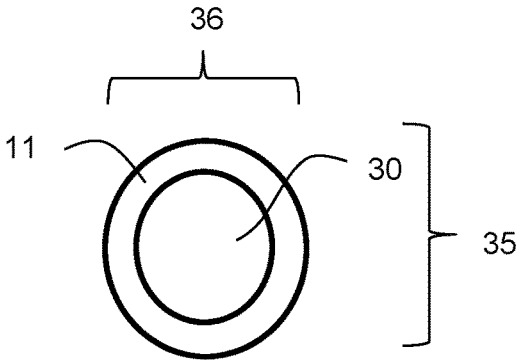
FIG. 3*d* is a top plan view of a bottom plate in accordance with some embodiments of the presently disclosed subject matter.

Back plate 25 can have length 35 and/or width 36 of about 2-6 inches in some embodiments (e.g., at least/no more than about 2, 2.5, 3, 3.5, 4, 4.5, 5, 5.5, or 6 inches). The term "length" refers to longest vertical distance of the plate. The term "width" refers to the longest horizontal distance of the plate. The back plate can further have thickness 37 of about 0.1-1 inches (e.g., at least/no more than about 0.1, 0.2, 0.3, 0.4, 0.5, 0.6, 0.7, 0.8, 0.9, or 1 inch), as shown in FIGS. 3*c* and 3*d*. The term "thickness" refers to the distance between the front and rear faces.

Figure 4A:
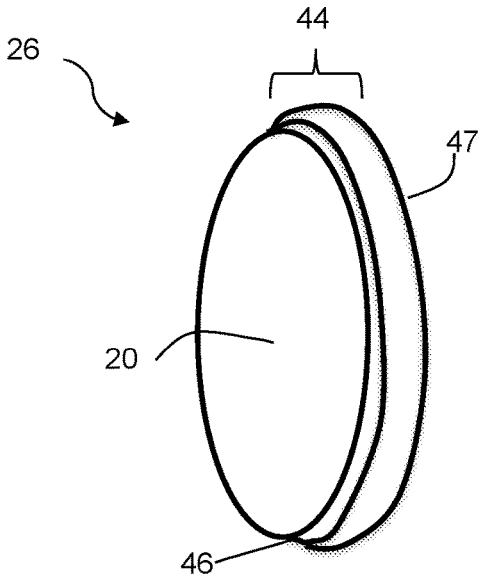
FIG. 4*a* is a perspective view of a middle plate with a bar of soap joined in accordance with some embodiments of the presently disclosed subject matter.
Figure 4B:
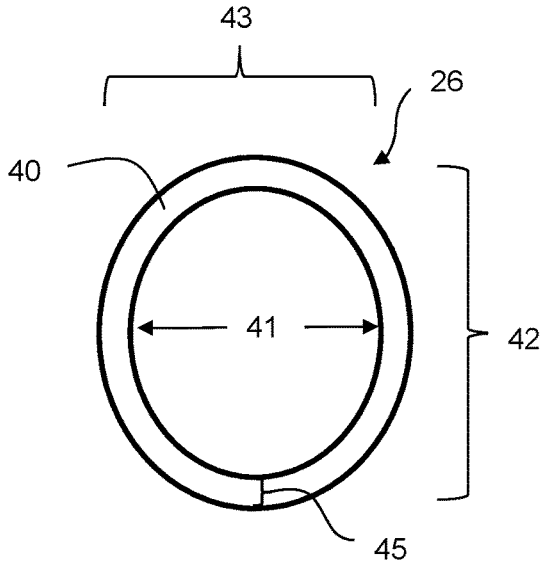
FIG. 4*b* is a top plan view of a middle plate in accordance with some embodiments of the presently disclosed subject matter.

One embodiment of middle plate 26 is shown in FIGS. 4*a* and 4*b*. The middle plate includes outer ring 40 and hollow interior 41 that is sized and shaped to accommodate soap 20. The middle plate can further include front face 46 and opposed rear face 47. Outer ring can have length 42 and/or width 43 of about 2-6 inches in some embodiments (e.g., at least/no more than about 2, 2.5, 3, 3.5, 4, 4.5, 5, 5.5, or 6 inches). The middle plate can further have thickness 44 (distance from topmost edge to bottommost edge of the ring) of about 0.1-1 inches (e.g., at least/no more than about 0.1, 0.2, 0.3, 0.4, 0.5, 0.6, 0.7, 0.8, 0.9, or 1 inch). The span 45 of the ring interior can be about 0.1-0.5 inches (e.g., at least/no more than about 0.1, 0.2, 0.3, 0.4, 0.5 inches).

Figure 4C:
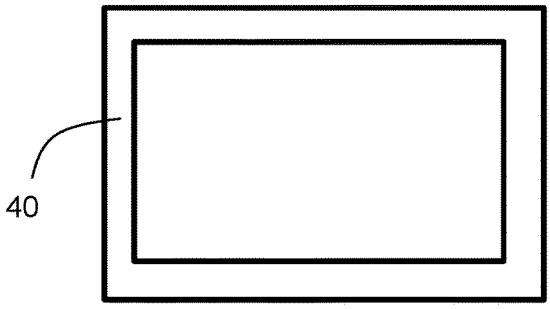
FIGS. 4*c* and 4*d* are top plan views of the rings of middle plates in accordance with some embodiments of the presently disclosed subject matter.
Figure 4D:
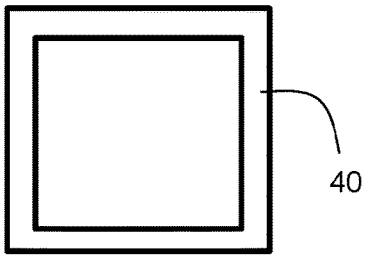

Soap 20 is housed within the hollow interior of the middle plate and can be held in position by the attachment of front plate 27. The interior of ring 40 can have any suitable shape to allow for cooperation with a bar of soap, as shown in FIGS. 4*c* and 4*d*.

The middle plate can be loosely held in between the front and back plates. Alternatively, the middle plate can be held in position by cooperating with the back plate. For example, the back plate can include one or more apertures 65 sized and shaped to releasably attach with extensions on the rear face of the middle plate ring.

Figure 5A:
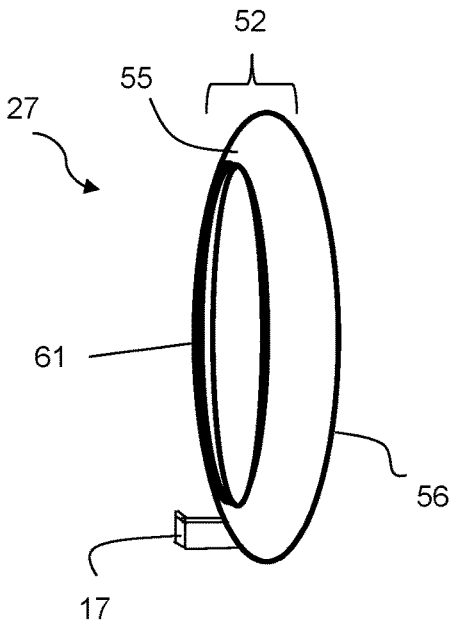
FIG. 5*a* is a perspective view of a front plate in accordance with some embodiments of the presently disclosed subject matter.
Figure 5B:
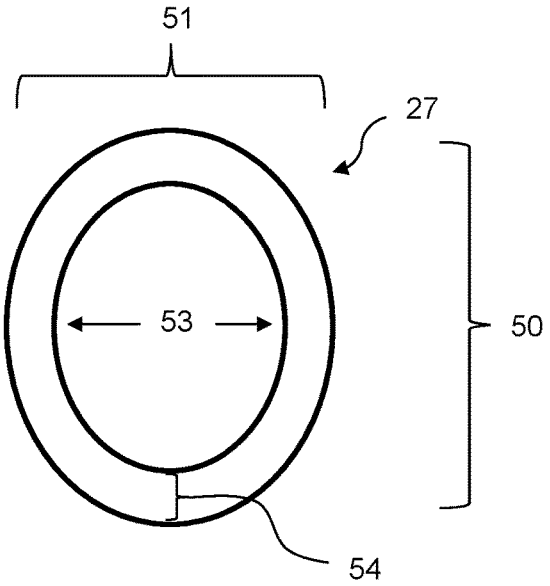
FIG. 5*b* is a top plan view of a front plate in accordance with some embodiments of the presently disclosed subject matter.

One embodiment of front plate 27 is illustrated in FIGS. 5*a* and 5*b*. The front plate includes top face 55 and opposed bottom face 56 with width 52 therebetween. The width of the top plate can be about 0.1-1 inches (e.g., at least/no more than about 0.1, 0.2, 0.3, 0.4, 0.5, 0.6, 0.7, 0.8, 0.9, or 1 inch). The top plate can include length 50 and/or width 51 of about 2-6 inches in some embodiments (e.g., at least/no more than about 2, 2.5, 3, 3.5, 4, 4.5, 5, 5.5, or 6 inches). The center portion of the top plate includes opening 53 that is sized and shaped to fit over middle plate 26, thereby retaining the soap within the assembly. Stated another way, the top face of the front plate overlaps with the front face of the soap and/or middle plate and connects with the bottom plate to sandwich the soap and middle plate within the interior of the assembly. In some embodiments, only the soap is present within opening 53. In other embodiments, the soap and part or all of ring 40 is present within opening 53. The front and bottom plates can attach together using any suitable method.

In some embodiments, the front plate fits over the back plate and middle plate, such that the front plate only is visible when the plates are assembled together. Thus, the front plate will be flush against the wall, with the back plate and middle plate concealed within the interior of the front plate. Thus, the length, width, and/or thickness of the front plate can be larger than the back and middle plates.

Optionally, the front plate can include one or more hangers 17 that function to retain a bathing accessory (e.g., loofah, washcloth, etc.). The hanger can have any desired configuration, such as a hook, bar, etc.

The back plate, middle plate, and front plate can be constructed from any resilient material suitable for surviving long term contact with water or steam. Suitable materials can therefore include (but are not limited to) plastic, metal (e.g., stainless steel, copper), fiberglass, glass, stone, rubber, ceramics, foamed material, or combinations thereof. In some embodiments, the material(s) used to construct the assembly is waterproof or water-resistant. The term "waterproof" refers to a material that is impervious to water or other liquids. The term "water-resistant" refers to the ability of a material to prevent the penetration of water or another liquid partially or substantially (but not fully).

The assembly can be constructed in a wide range of colors and patterns to coordinate with any bathroom décor.

The disclosed assembly further includes soap 20, as set forth above. The term "soap" broadly refers to any solid or semi-solid material that can be used to clean a surface, such as the human body. Suitable soaps can include any salt of a fatty acid that can solubilize dirt, oils, and other particulates. In some embodiments, soap 20 is selected to kill microorganisms by disorganizing their lipid bilayer and/or denaturing proteins. Soap 20 can also emulsify oils, allowing them to be washed away. Soap 20 can optionally include one or more additional components, such as fragrances and/or colorants, as would be known in the art.

It should be appreciated that soap 20 should be shaped to releasably fit within opening 41 of the middle plate and within recess 30. Thus, the soap can have a circumference that is slightly larger than the circumference of the recess. In this way, the soap is tightly held within the assembly and cannot easily be dislodged by inadvertent contact by the user. However, the user can remove the soap by providing pressure to dislodge lip 80 from the housing ribs. Alternatively, the soap can be about the same size as opening 41 and the recess, as it held in place by front plate 27. In this way, the soap can be replaced as desired.

Figure 6:
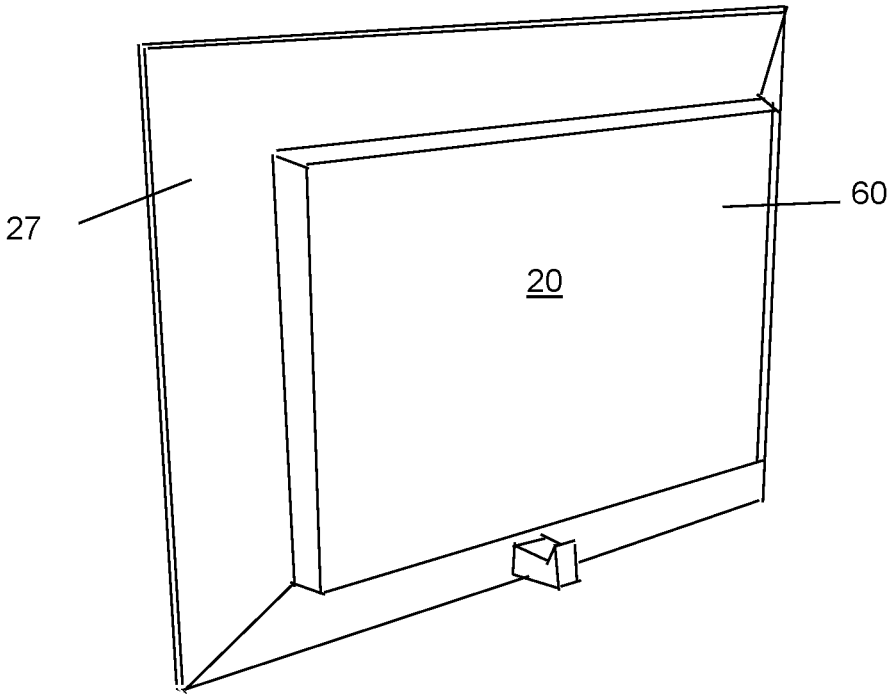
FIG. 6 is a perspective view of a soap dish assembly comprising soap in accordance with some embodiments of the presently disclosed subject matter.

FIG. 6 illustrates one embodiment of soap 20 comprising front face 60 and an opposed rear face that is positioned within the interior of the assembly. The front face of the soap is accessible by the user, while the rear face is positioned adjacent to the rear plate, within recess 30. As shown, the front plate includes lip 61 that extends about the circumference of opening 53. The lip contacts ring 40 of the middle plate to retain the soap in place. In addition, the lip ensures that the rear face of the soap is protected from contact with water, such as during showering.

In use, the rear face of back plate 25 is attached to a desired support surface, such as a shower wall, as shown in FIGS. 6*a* and 6*b*. Specifically, the rear face of the back plate is attached to the support surface using one or more retention elements (e.g., double sided tape). The back plate will be retained in position on the support surface for a desired amount of time. Soap 20 can be then positioned within the middle plate opening. The middle plate can be held between the front and rear plates. Specifically, the rear face of the front plate is attached to the front face of the back plate using any standard method. The middle plate and attached soap is held in place therebetween. In this way, the soap is tightly held and maintained within the assembly for a desired amount of time.

The front and side faces of soap 20 are accessible to the user. A bathing accessory (e.g., washcloth, sponge, loofah, etc.) can be rubbed on the exposed portion of the soap to transfer a desired amount of soap to the accessory. The accessory can then be used to clean the user's body or any other object (e.g., a pet, dishes, etc.). Alternatively, a body part can be directly contacted with soap 20 (e.g., the user's back or arms), providing for hands-free use. Even as the soap decreases in size from use, it will remain positioned within the housing recess.

Any excess water that contacts the soap assembly will simply run off the device and does not pool within the soap recess. In this way, sogginess and breakdown of the soap is avoided. Thus, use of the disclosed soap assembly will ensure that soap 20 will always be contained in a convenient location free from pools of water. As a result, the soap will not become softened and unusable.

When the soap runs low or the user desires to remove the soap, the user simply applies light pressure, thereby uncoupling the front and rear plates. The soap can be removed by applying light pressure. A new soap bar can then be deposited within the middle plate opening, and the front plate reattached to the back plate, as described above. Thus, soap 20 can be replaced as needed, while the assembly can be reused as many times as desired.

If a user desires to remove the back plate from the support surface, light pressure can be applied to detach retention elements 50. The device can then be relocated to a different location.

Assembly 5 provides several advantages over prior art soap dish assemblies. For example, because soap 20 is not in constant contact with water, the life of the soap is extended.

In addition, the soap does not become soggy and/or waterlogged. Rather, it maintains its shape and consistency throughout the life of the soap.

The assembly allows a user to access soap 20 without having to handle it directly. Instead, a washcloth, loofah, or other item is simply rubbed across the exposed soap surface to transfer a desired amount of soap.

The assembly is lightweight yet durable in design and allows for the cleaning and scrubbing of a user's body with ease and minimal effort. As such, assembly 5 is convenient, effective, and saves time.

Assembly 5 can be easily attached and enjoyed by a wide variety of users, including children, the elderly, and those with chronic issues (e.g., arthritis).

Advantageously, the disclosed assembly is portable, allowing a user to easily change locations as desired.

Assembly 5 can be used in a variety of settings, such as on a countertop, sink ledge, shower wall, bathtub, and the like.

While the foregoing description and figures are directed toward the preferred embodiment in accordance with the present invention, it should be appreciated that numerous modifications can be made to each of the components of the soap holder 10 as discussed above. Indeed, such modifications are encouraged to be in the materials, structure and arrangement of the disclosed embodiments of the present invention without departing from the spirit and scope of the same. Thus, the foregoing description of the preferred embodiments should be taken by way of illustration rather than by way of limitation, as the present invention is defined by the claims set forth below.

What is claimed is:

1. A soap dish assembly comprising:

a bottom plate defined by a rear face and an opposed top face, wherein the top face includes a recess:

a middle plate configured with a central opening and an outer ring, wherein the outer ring is sized and shaped to be housed within the recess;

a front plate defined by a central opening with a circumference that is smaller than a circumference of the central opening of the middle plate;

wherein the front plate releasably attaches to a rear plate, such that the middle plate is positioned therebetween;

wherein the recess comprises a first indentation sized and shaped to accommodate the outer ring and a second indentation within the first indentation.

2. The assembly of claim 1, further comprising a bar of soap defined by a front face, a rear face, and a thickness therebetween, wherein the bar of soap is positioned within the central opening of the middle plate and directly adjacent to the recess.

3. The assembly of claim 2, wherein the bar of soap has a circumference that is about the same as the central opening of the middle plate.

4. The assembly of claim 1, wherein the rear face of the bottom plate comprises one or more attachment elements selected from double sided tape, adhesive, suction cups, clasps, fasteners, magnets, hook and loop closure, screws, bolts, or combinations thereof.

5. The assembly of claim 1, wherein the recess has a depth of about 0.1-2 inches.

6. The assembly of claim 1, wherein the front plate includes a lip positioned adjacent to the central opening of the front plate, wherein the lip contacts the top face of the bottom plate.

7. The assembly of claim 1, wherein the front plate includes a hanger.

8. The assembly of claim 1, wherein atop face of the front plate entirely fits over atop face of the rear plate.

9. The assembly of claim 2, wherein the soap is flush with the central opening of the front plate.

10. The assembly of claim 1, wherein the front plate includes a drain.

11. A method of using a soap dish assembly, the method comprising:

positioning the soap dish assembly of claim 1 on a support surface, such that the rear face of the bottom plate is directly adjacent to the support surface;

positioning a bar of soap within the central opening of the middle plate and adjacent to the recess, wherein the bar of soap is defined by a front face, a rear face, and a thickness therebetween, and wherein the soap is held in position by the attachment of the front plate to the rear plate;

accessing the front face and thickness of the soap to clean a surface.

12. The method of claim 11, wherein the soap is releasably positioned with the central opening of the middle plate.

13. The method of claim 11, wherein the rear face of the bottom plate is planar.

14. The method of claim 11, wherein the rear face of the bottom plate comprises one or more attachment elements selected from double sided tape, adhesive, suction cups, clasps, fasteners, magnets, hook and loop closure, screws, bolts, or combinations thereof.

15. The method of claim 11, wherein the recess has a depth of about 0.1-2 inches.

16. The method of claim 11, wherein the front plate includes a hanger.

17. The method of claim 11, wherein a top face of the front plate entirely fits over a top face of the rear plate.

18. The method of claim 11, wherein the soap is flush with the central opening of the front plate.

19. The method of claim 11, wherein the bar of soap has a circumference that is about the same as the a circumference of the central opening of the middle plate.

* * * * *